United States Patent [19]

Ebesu

[11] Patent Number: 4,750,455

[45] Date of Patent: Jun. 14, 1988

[54] CAMSHAFT DRIVING DEVICE FOR INTERNAL COMBUSTION ENGINE

[75] Inventor: Hidesaku Ebesu, Hiroshima, Japan

[73] Assignee: Mazda Motor Corporation, Hiroshima, Japan

[21] Appl. No.: 893,211

[22] Filed: Aug. 5, 1986

[30] Foreign Application Priority Data

Aug. 6, 1985 [JP] Japan ..... 60-120786
Aug. 6, 1985 [JP] Japan ..... 60-120789

[51] Int. Cl.[4] ..... F01L 1/04
[52] U.S. Cl. ..... 123/90.31; 123/90.27
[58] Field of Search ..... 123/90.27, 90.31, 90.33; 184/15.1

[56] References Cited

U.S. PATENT DOCUMENTS 3,393,499 7/1968 Harer et al. ..... 184/15.1
4,291,650 9/1981 Formia et al. ..... 123/90.27
4,549,510 10/1985 Miyakoshi et al. ..... 123/90.27

FOREIGN PATENT DOCUMENTS 3012417 10/1981 Fed. Rep. of Germany ... 123/90.27
0015612 1/1984 Japan ..... 123/90.27
2128679 5/1984 United Kingdom ..... 123/90.27

*Primary Examiner*—Willis R. Wolfe, Jr.
*Assistant Examiner*—M. Macy
*Attorney, Agent, or Firm*—Burns, Doane, Swecker & Mathis

[57] ABSTRACT

A camshaft driving device for use in an internal combustion engine having a cylinder block, a cylinder head disposed on the cylinder block, a driving shaft rotatably mounted at the lower portion of the cylinder block and at least one camshaft rotatably mounted at the upper portion of the cylinder head, wherein a mounting boss for mounting the reduction gear thereon is formed on an upper deck disposed on the cylinder block, while a driving force from the driving shaft is transmitted to the camshaft through the reduction gear. A transmitting portion of the reduction gear on the side of the camshaft is outwardly disposed from the engine as compared with another transmitting portion thereof on the side of the driving shaft and the transmitting portion of the latter is disposed in a space immediately below a journal boss formed at the upper portion of the cylinder head for rotatably mounting the camshaft therein.

4 Claims, 2 Drawing Sheets

CAMSHAFT DRIVING DEVICE FOR INTERNAL COMBUSTION ENGINE

BACKGROUND OF THE INVENTION

The present invention generally relates to an internal combustion engine and more particularly, to a camshaft driving device for use in an internal combustion engine having a reduction gear therein, which can be increased in rigidity and whereby the engine can be formed into a compact size.

As one of the methods for driving one or more camshafts of an internal combustion engine, there has generally been widely employed such a driving system in which a camshaft or camshafts are directly driven by a driving shaft through an endless chain or an endless belt which is passed around therebetween.

In a driving system of this kind for directly driving the camshafts, however, since there is necessarily arranged on each camshaft, a gear having a diameter two times larger than that of a gear arranged on the driving shaft in terms of the reduction gear ratio, the engine is undesirably increased in size in the radial direction of the driving shaft.

Accordingly, in order to eliminate the aforementioned drawback and to cause the engine to be compact, there has been proposed a camshaft driving system as disclosed, for example, in Japanese Utility Model Laid-Open Publication Jikkaisho No. 59-35603, wherein a reduction gear is disposed between a driving shaft and camshafts so as to transmit a driving force from the driving shaft to the camshafts through the reduction gear and chains or belts, and this results in that the gears such as pulleys or sprockets of the camshafts can be restricted to be small in diameter.

In the camshaft driving system for use in the internal combustion engine having the aforementioned reduction gear therein, however, since the reduction gear receives not only a fluctuating torque produced by an explosion force from the driving shaft, but also that produced by a cam lift from the side of the camshafts, a large amount of load acts on a supporting portion for the reduction gear. Nevertheless, when the supporting portion for the reduction gear is reinforced on a large scale, the engine in inevitably increased in weight.

Furthermore, since such reduction gear is composed of a pair of gears e.g. timing pulleys or sprockets which are integrally formed together with a shaft disposed therebetween in the axial direction of the driving shaft, there arises such a drawback that the engine is undesirably increased in size in the axial direction of the driving shaft owing to the arrangement of the reduction gear.

SUMMARY OF THE INVENTION

Accordingly, the present invention has been developed with a view to substantially eliminating the above described disadvantages inherent in the prior art arrangement of the reduction gear, and has for its essential object to provide an improved camshaft driving device for use in an internal combustion engine whereby the reduction gear can be increased in rigidity with restricted weight of the engine by forming a mounting boss for supporting the reduction gear on a portion of the engine body having a high rigidity.

Another object of the present invention is to provide a camshaft driving device for use in an internal combustion engine of the above described type whereby the engine can be minimized in the increase of its size in the axial direction of the driving shaft and the gears e.g. timing pulleys or sprockets of the camshafts can be restricted to be small in diameter so as to form the engine into compact size in the radial direction of the driving shaft by arranging a portion of the reduction gear in a space defined below a journal boss for the camshafts.

More specifically, in connection with the fact that a driving pulley for driving auxiliary machineries is mounted on the drive shaft of the engine, since a transmission system on the side of the camshafts for transmitting a torque from the reduction gear to the camshafts is outwardly arranged as compared with another transmission system on the side of the drive shaft for transmitting a driving force from the drive shaft of the engine to the reduction gear, it is required to steadily support the camshafts extending outwardly from the engine body. Furthermore, since it is necessary to avoid an interference between the camshafts and a large number of members such as head bolts for securely connecting the cylinder head to the cylinder block, bosses therefor and the like disposed on a bulkhead portion of the cylinder head, the journal boss for the camshafts are occasionally arranged on the bulkhead portion of the cylinder head so as to protrude outwardly from a side wall of a water jacket. According to the present invention, the reduction gear is advantageously disposed in the internal combustion engine in consideration of the above described arrangement.

In accomplishing these and other objects, according to one preferred embodiment of the present invention, there is provided a camshaft driving device for use in an internal combustion engine having a cylinder block, a cylinder head disposed on the cylinder block, a driving shaft rotatably mounted at the lower portion of the cylinder block and at least one camshaft rotatably mounted at the upper portion of the cylinder head, wherein a mounting boss for mounting the reduction gear thereon is formed on an upper deck disposed on the cylinder block, while a driving force from the driving shaft is transmitted to the camshaft through the reduction gear. Furthermore, a transmitting portion of the reduction gear on the side of the camshaft is outwardly disposed from the engine as compared with another transmitting portion thereof on the side of the driving shaft and the transmitting portion of the latter is disposed in a space immediately below a journal boss formed at the upper portion of the cylinder head for rotatably mounting the camshaft therein.

According to the above described construction, not only the reduction gear can be increased in rigidity by forming the mounting boss for mounting the reduction gear on the upper deck of the cylinder block which is high in rigidity, but also the engine can be restricted in the increase of its weight, since the existing upper deck of the cylinder block is utilized in this construction.

Furthermore, since each of the gears arranged on the camshafts can be restricted to be small in diameter by employing the reduction gear, the engine is caused to be compact in the radial direction of the drive shaft. In addition, since the transmitting portion of the reduction gear on the side of the drive shaft is disposed in the space defined below the journal boss for the camshafts by arranging the transmitting portion of the reduction gear on the side of the camshafts outwardly from the engine body as compared with that on the side of the drive shaft, the engine can be minimized in the increase of its size in the axial direction of the drive shaft.

BRIEF DESCRIPTION OF THE DRAWINGS

These and other objects and features of the present invention will become apparent from the following description taken in conjunction with the preferred embodiment thereof with reference to the accompanying drawings, throughout which like parts are designated by like reference numerals, and in which.

DETAILED DESCRIPTION OF THE INVENTION

Figure 1:
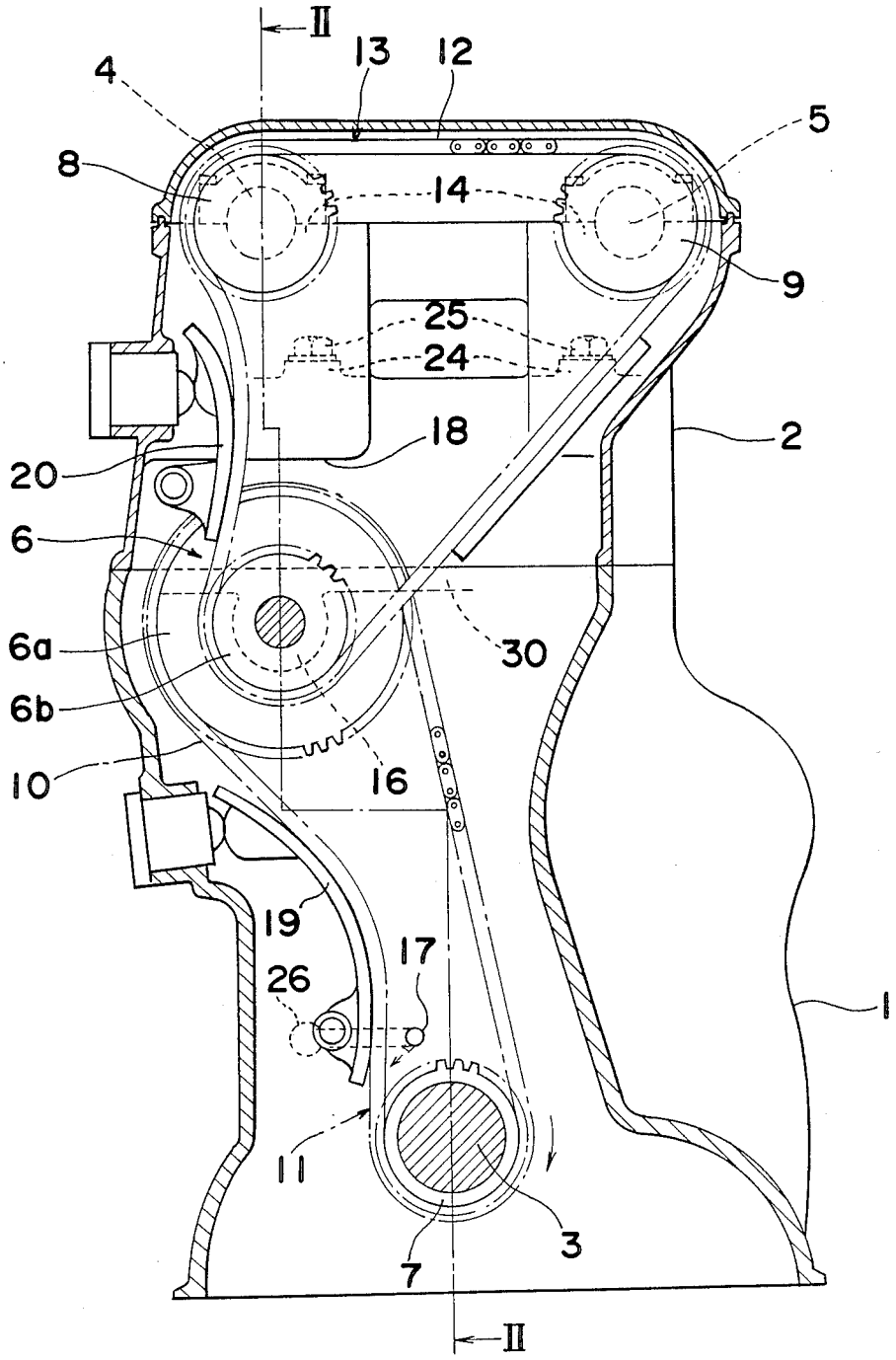
FIG. 1 is a front view of a cylinder block and a cylinder head of an internal combustion engine of the present invention according to one preferred embodiment thereof.
Figure 2:
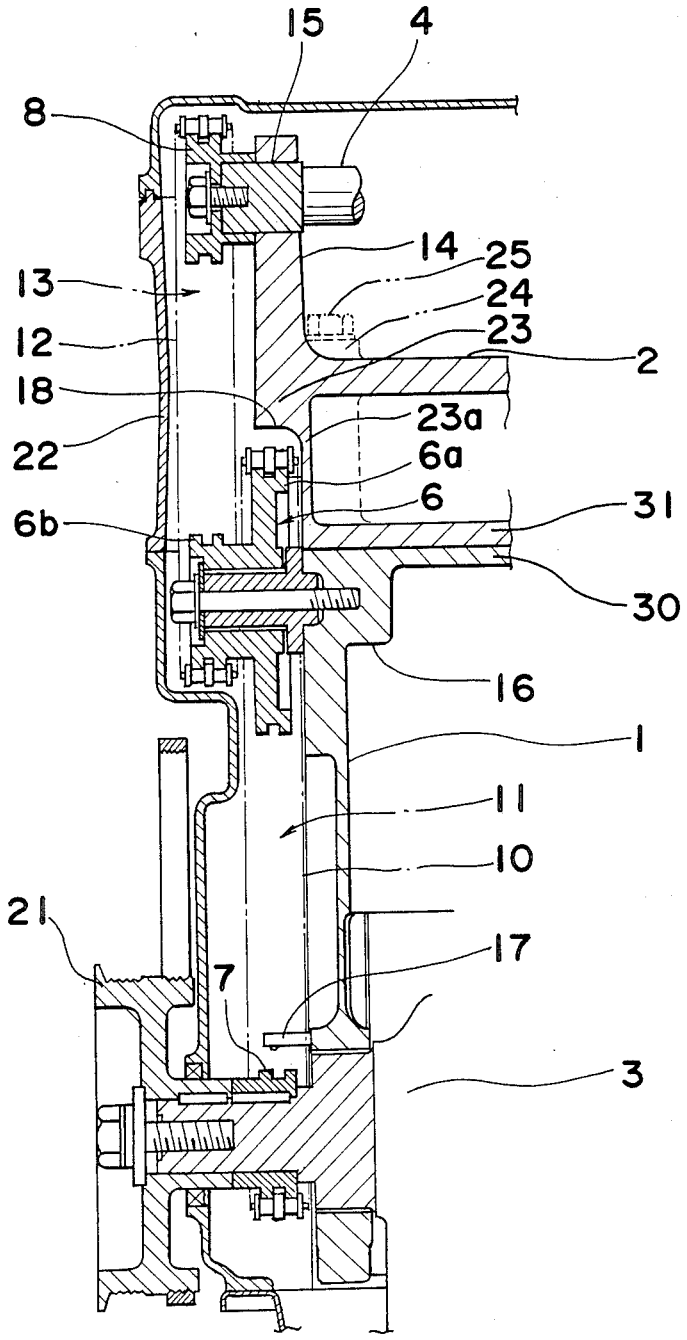
FIG. 2 is a cross section taken along the line II—II in FIG. 1.

Referring now to the drawings, there is shown in FIGS. 1 and 2, an internal combustion engine of double over head cam type having a camshaft driving device according to one preferred embodiment of the present invention.

In FIGS. 1 and 2, the internal combustion engine is provided with a cylinder block 1, a cylinder head 2 disposed on the cylinder block 1, a crankshaft 3 rotatably mounted as a driving shaft at the lower portion of the cylinder block 1 and a pair of camshafts 4 and 5 rotatably mounted at the upper portion of the cylinder head 2 for exclusive use for an intake and an exhaust systems respectively, in a state where they are parallel to the crankshaft 3, with a cylinder case being composed of the cylinder block 1 and the cylinder head 2 by connecting an upper deck 30 formed at the upper portion of the former with a lower deck 31 formed at the lower portion of the latter.

Furthermore, a reduction gear 6 is disposed between the crankshaft 3 and the camshafts 4 and 5 in the cylinder block 1, and includes an input sprocket 6*a* as a transmitting portion on the side of the driving shaft and an output sprocket 6*b* having half the number of teeth of the input sprocket 6*a* as another transmitting portion on the side of the camshafts, while both of the input and the output sprockets 6*a* and 6*b* are integrally formed with a shaft. A mounting boss 16 for rotatably supporting the reduction gear 6 thereon is also integrally formed together with the upper deck 30 which is horizontally arranged on the upper end of the cylinder block 1.

Moreover, sprockets e.g. timing gears 7, 8 and 9 each having a same number of teeth are securely mounted on the crankshaft 3 and the camshafts 4 and 5, respectively. A first transmission system 11 is so formed on the side of the drive shaft that an endless chain 10 is passed around between the sprocket 7 of the crankshaft 3 and the input sprocket 6*a* of the reduction gear 6. On the other hand, a second transmission system 13 is also so formed on the side of the camshafts in a similar manner as the side of the driving shaft that an endless chain 12 is passed around among the output sprocket 6*b* of the reduction gear 6 and both of the sprockets 8 and 9 of the camshafts 4 and 5. In the above described transmission systems 11 and 13, a driving force from the crankshaft 3 is transmitted to the camshafts 4 and 5 through the reduction gear 6 so as to drive them at half the speed of the crankshaft 3.

The output sprocket 6*b* of the reduction gear 6 is disposed outwardly as compared with the input sprocket 6*a* thereof as shown in FIG. 2, and this results in that the second transmission system 13 is arranged outwardly rather than the first transmission system 11.

In addition, the camshafts 4 and 5 are rotatably mounted on a journal boss 14 which is integrally formed together with the cylinder head 2 at the upper portion thereof. The journal boss 14 is so constructed that it is disposed on a bulkhead portion 23 of the cylinder head 2 so as to protrude frontwards from a side wall 23*a* of a water jacket for securely supporting a pair of bearings 15 in which each end portion of the camshafts 4 and 5 is freely rotatably inserted, with a detachable chain case 22 being arranged on the cylinder head 2 for covering the journal boss 14. Thus, not only the camshafts 4 and 5 extending rather outwardly e.g. frontwards than the first transmission system 11 are steadily supported on the journal boss 14, but also an interference between the journal boss 14 and head bolts 25 mounted on the bulkhead portion 23 or bosses 24 therefor is avoided on the cylinder head 2. The lower end portion of the journal boss 14 is so formed as an oil guide wall 18 lapping over the input sprocket 6*a* both in the radial direction thereof and in the axial direction of the driving shaft that oil transported by the chain 10 and splashed in a peripheral direction of the input spocket 6*a* is caused to adhere to the chain 12 for lubrication thereof by being guided frontwards.

Meanwhile, an oil gallery 26 is defined at the lower portion of the cylinder block 1 in a state where it is parallel to the crankshaft 3. An oil jet nozzle 17 communicating the oil gallery 26 is disposed immediately above the sprocket 7 of the crankshaft 3 so as to face the inner peripheral surface of the chain 10 for discharging the oil supplied into the oil gallery 26 towards the chain 10.

Furthermore, there are arranged chain tensioners 19 and 20 in the cylinder block 1 and in the cylinder head 2 respectively, for guiding the respective chains 10 and 12, and a crank pulley 21 is securely mounted on the crankshaft 3 for driving auxiliary machineries.

Accordingly, in the above described embodiment, since each of the sprockets 8 and 9 of the camshafts 4 and 5 can be reduced in diameter by employing the reduction gear 6, the internal combustion engine can be compactly manufactured with reduced size in the radial direction of the driving shaft.

Furthermore, since the mounting boss 16 for the reduction gear 6 is integrally formed together with the upper deck 30 of the cylinder block 1 which is high in rigidity and is reinforced thereby, it can be increased in rigidity for supporting the reduction gear 6 and is caused to have a sufficient strength against a fluctuating torque which is transmitted from the crankshaft 3 or the camshafts 4 and 5, thus resulting in that the internal combustion engine can be desirably increased in reliability.

Besides, there arises no increase in weight of the engine owing to the fact that the increased rigidity of the engine can be attained by utilizing the upper deck 30 of the existing cylinder block 1.

Moreover, since from a viewpoint of the steady support of the camshafts 4 and 5 and the avoidance of the interference between the cylinder head 2 and other members, the journal boss 14 of the camshafts 4 and 5 is so disposed as to protrude frontwards from the side wall 23*a* of the water jacket of the bulkhead portion 23 and the input sprocket 6*a* of the reduction gear 6 is disposed in a space defined below the journal boss 14, the engine can be minimized in the increase of its size in an axial direction of the driving shaft.

In addition, since the lower end portion of the journal boss 14 is formed as the oil guide well 18 and the chain 12 on the side of the camshafts 4 and 5 is lubricated by the oil transported by the chain 10 on the side of the drive shaft, it is not required to provide an additional oil jet nozzle for exclusive use for the chain 12, thus resulting in that the arrangement of the oil jet nozzle can be simplified.

In the above described embodiment, although each of the first and the second transmission systems 11 and 13 is composed of the chain transmission system, it may be modified to be composed of a belt transmission system or one of other transmission systems using a generally endless members.

The present invention is also applicable to the camshaft driving device for use in the internal combustion engine of single over head cam type or the like having the reduction gear therein, as well as that of double over head cam type in accordance with the above described embodiment.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A camshaft driving device for use in a double overhead cam type internal combustion engine having a cylinder block, an upper deck formed at an upper portion of said cylinder block, a cylinder head disposed on said cylinder block, a driving shaft rotatably mounted at a lower portion of said cylinder block, and a pair of camshafts rotatably mounted at an upper portion of said cylinder head, said camshaft driving device comprising:

a reduction gear means including a first transmitting portion having a sprocket on one side thereof for being driven by said driving shaft and a second transmitting portion having another sprocket on an opposite side thereof for driving said pair of camshafts, both of said sprockets being positioned on a common shaft with the sprocket of said first transmitting portion having a larger diameter than that of said second transmitting portion, said transmitting portion of said reduction gear means being positioned further from the engine than said first transmitting portion of said reduction gear means and said first transmitting portion is positioned in a space defined immediately below a journal boss of said cylinder head so that said journal boss is lapped over said first transmitting portion in an axial direction of the driving shaft, said journal boss being formed at the upper portion of such cylinder head for rotatably mounting said pair of camshafts therein;

driving force transmitting endless chain members engaging in said reduction gear means for transmitting a driving force from said driving shaft to said pair of camshafts through said reduction gear means; and said camshaft driving device further including a plurality of chain tensioners for tightening said chain, a nozzle means for supplying a lubricating oil to said driving force chain members on the side of the driving shaft and an oil guide wall formed immediately above said sprocket of said transmitting portion of said reduction gear means at a lower end portion of said journal boss and lapping thereover both in the radial direction and in the axial direction of the driving shaft, wherein a mounting boss for mounting said reduction gear means thereon is formed on said upper deck of said cylinder block.

2. A camshaft driving device for use in an internal combustion engine as claimed in claim 1, wherein a pair of camshafts are rotatably mounted at the upper portion of said cylinder head of the internal combustion engine of double over head cam type, and said journal boss for rotatably supporting said camshafts therein and bosses for head bolts for securely connecting said cylinder head to said cylinder block are lapped with each other in a radial direction of the camshafts, said bosses for head bolts being formed at the upper portion of said cylinder head.

3. A camshaft driving device for use in an internal combustion engine having a cylinder case, a cylinder block forming a lower half of said cylinder case and having an upper deck at an upper portion thereof, a cylinder head forming an upper half of said cylinder case and having a lower deck at a lower portion thereof, a driving shaft rotatably mounted at a lower portion of said cylinder block, a pair of camshafts rotatably mounted at an upper portion of said cylinder head, a journal boss formed at the upper portion of said cylinder head, a bearing arrangement disposed at an end portion of said journal boss for rotatably supporting said pair of camshafts therein, a driving shaft sprocket securely mounted on said driving shaft, and at least one camshaft sprocket securely mounted on at least one of said pair of camshafts, wherein said cylinder block and said cylinder head are securely connected with each other through the upper and lower decks for forming said cylinder case, and both of said driving shaft sprocket and said camshaft sprocket are outwardly positioned on one side of said cylinder case, said camshaft driving device comprising:

a reduction gear means having a first sprocket, a second sprocket of a diameter smaller than that of said first sprocket and a shaft for connecting both of said sprockets for rotation together therewith, said first sprocket being positioned in a space defined immediately below said journal boss of said cylinder head so that said journal boss is lapped over said first sprocket in an axial direction of the driving shaft, said reduction gear means being outwardly disposed on one side of said cylinder case in the vicinity of a mating surface between said cylinder block and said cylinder head;

driving force transmitting endless chain members engaging with said reduction gear means for transmitting a driving force from said driving shaft to said pair of camshafts through said reduction gear means; and said camshaft driving device further including a plurality of chain tensioners for tightening said chain, a nozzle means for supplying a lubricating oil to said driving force chain members on the side of the driving shaft and an oil guide wall formed immediately above said sprocket of said transmitting portion of said reduction gear means at a lower end portion of said journal boss and lapping thereover both in the radial direction and in the axial direction of the driving shaft.

wherein said driving shaft gear and said first gear are arranged adjacently to said cylinder case in the axial direction of the driving shaft as compared with said camshaft gear and said second gear, and said bearing is lapped over said first gear in the axial direction of the driving shaft.

4. A camshaft driving device for use in an internal combustion engine as claimed in claim 3, wherein a pair of camshafts are rotatably mounted at the upper portion of said cylinder head of the internal combustion engine of double over head cam type, and said journal boss for rotatably supporting said camshafts and bosses for head bolts are lapped with each other in a radial direction of the camshafts, said bosses for head bolts being formed on a bulkhead portion of said cylinder head.

* * * * *